United States Patent [19]

Bross

[11] Patent Number: 4,680,464

[45] Date of Patent: Jul. 14, 1987

[54] OPTICAL DETECTING SYSTEM FOR ARTICLE COUNTING MACHINE

[75] Inventor: Charles F. Bross, Chicago, Ill.

[73] Assignee: Pennwalt Corporation, Philadelphia, Pa.

[21] Appl. No.: 802,548

[22] Filed: Nov. 27, 1985

[51] Int. Cl.[4] ..... G06M 7/02; B65B 57/14

[52] U.S. Cl. ..... 250/223 R; 53/57

[58] Field of Search ..... 250/222.1, 223 R, 561; 53/54–57, 73–74, 501; 221/2, 7

[56] References Cited

U.S. PATENT DOCUMENTS

| | | | |
|---|---|---|---|
| 3,139,713 | 7/1964 | Merrill et al. | 53/55 |
| 3,925,960 | 12/1975 | Saari et al. | 53/78 |
| 4,017,003 | 4/1977 | Heino | 221/81 |
| 4,094,129 | 6/1978 | List | 53/54 |
| 4,241,293 | 12/1980 | Bross | 250/223 R X |
| 4,408,295 | 10/1983 | Kavage et al. | 250/223 R X |

OTHER PUBLICATIONS

Opcon "20/20 Vision Systems" 4 page Advertistment Brochure, 720 8th St. S.W., Everett, WA 98203-6299.

*Primary Examiner*—Eugene R. LaRoche
*Assistant Examiner*—David Mis
*Attorney, Agent, or Firm*—Seidel, Gonda, Goldhammer & Abbott

[57] ABSTRACT

An optical detecting system for a machine for counting individual articles and delivering a preselected quantity of articles into receptacles. The system optically illuminates individual article receiving locations on an endless conveyor made up of elongated article receiving flights and produces optically-detectable indications of the presence or absence of an article at one or more article receiving locations. A reflector displays the optically-detectable indications to an optical detector, such as a camera, which generates an electronic signal representative of the optically-detectable indication. Associated circuitry generates a second electronic signal indicative of the presence or absence of an article in one or more receiving locations. The second electronic signal may be used to derive a count of articles delivered into the receptacles, and to actuate ejection of receptacles which are under-filled.

21 Claims, 5 Drawing Figures

FIG. 3
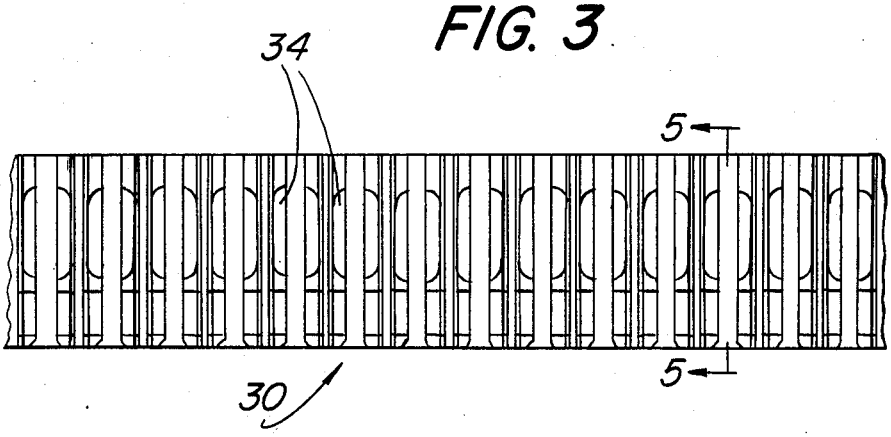
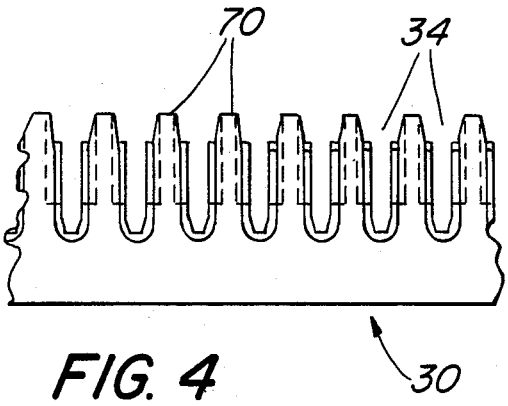
FIG. 4
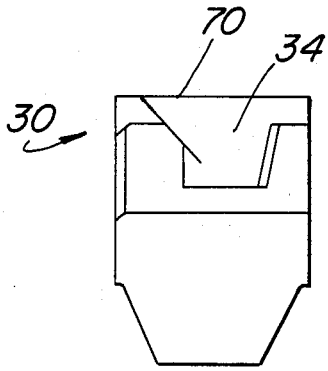
FIG. 5

OPTICAL DETECTING SYSTEM FOR ARTICLE COUNTING MACHINE

BACKGROUND OF THE INVENTION

This invention relates to machines for counting articles, for example pills or capsules, and filling the proper count of articles into each of a number of receptacles, for example bottles, brought to a stationary position at a filling station. Such machines are characterized by an endless conveyor comprising article receiving flights adapted to discharge into side-by-side chutes having discharge tubes which in turn discharge into a suitable receptacle, such as a bottle or the like. Each of the flights is elongated and has a plurality of article receiving locations aligned with the chutes, and each flight delivers the same number of articles to each chute. A given number of filled flights will thus load each receptacle or bottle with a given number of articles or pills.

Occasionally, one or more article receiving locations on a conveyor flight will, for one reason or another, not contain an article. The receptacle associated with that article receiving location will therefore be under-filled by one article. The present invention is directed to a solution to the problem of automatically detecting the absence of articles at an article receiving location on a coveyor flight and for ultimately ejecting under-filled receptacles.

SUMMARY OF THE INVENTION

The present invention is an optical detecting system for a machine for counting individual articles and delivering a preselected quantity of articles into a plurality of receptacles. The machine has an endless conveyor having elongated article receiving flights adapted to receive, transport and discharge the articles into the receptacles. Each article receiving flight has a plurality of spaced article receiving locations therealong. Each article receiving location corresponds to an individual one of the receptacles and each receives a single article for transport and discharge. The optical detecting system comprises illuminating means for illuminating the article receiving locations with an optical beam for producing optically-detectable indications of the presence or absence of an article in one or more individual article receiving locations. Reflective means are provided for displaying the optically-detectable indications. An optical detector means is operatively associated with the reflective means for detecting the optically-detectable indications and for generating an electronic signal representative of said indications. The apparatus further comprises processor means for processing the electronic signal and generating in response thereto a second electronic signal indicative of the presence or absence of an article in one or more individual article receiving locations.

As used in this specification and claims, the terms "optical" and "optically-detectable" are not limited to radiation detectable by the human eye, but include infrared radiation as well. These terms should be read in a general sense and not as in any way limiting the scope of the invention.

The invention also includes means responsive to the second electronic signal for generating one or more count signals indicative of the total number of articles delivered to individual receptacles, and may further include means responsive to the count signal for ejecting an individual receptacle when the total number of articles delivered to the receptacle is below a predetermined minimum.

The apparatus may also include means responsive to the second electronic signal for generating an operator-detectable detectable indication of the presence or absence of an article in one or more article receiving locations and may include operator-actuatable means for ejecting a receptacle corresponding to an empty article receiving location when the operator-detectable indication indicates the absence of an article in said article receiving location.

It is an object of the invention to automatically detect missing articles in an article counting machine.

It is a further object of the invention to alert an operator of a missing article by generating a visible and/or audible indication of a missing article.

It is a further object of the invention to track under-filled receptacles from the filling location to a discharge location, where under-filled receptacles may be ejected.

It is a further object of the invention to monitor a count of under-filled receptacles and properly filled receptacles, and to display the count.

Other objects and advantages of the invention will become apparent hereinafter.

DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 3 is a top plan view of a portion of a typical article receiving flight.

FIG. 4 is a side elevation view of the portion of the article receiving flight shown in FIG. 3.

FIG. 5 is a sectional view taken along the line 5—5 in FIG. 3.

DESCRIPTION OF THE PREFERRED EMBODIMENT

Figure 1:
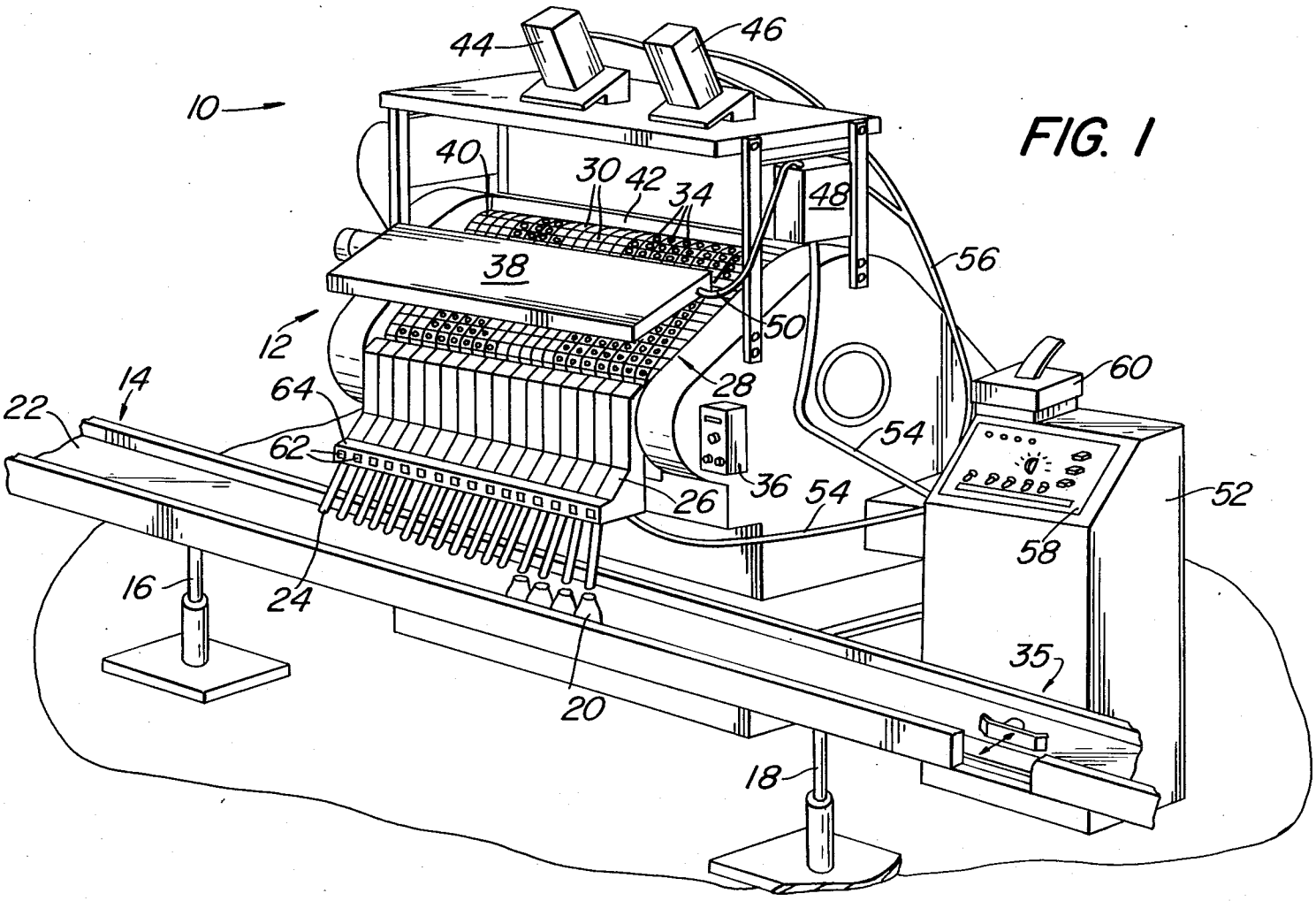
FIG. 1 is a perspective view of an article counting machine equipped with the apparatus of the present invention.

Referring now to the drawings, wherein like numerals indicate like elements, there is shown in FIG. 1 the optical detection system according to the present invention. The article counting machine is designated generally by reference numeral 12. Associated with article counting machine 12 is a linear conveyor 14, supported by pedestals 16 and 18. Bottles 20 to be filled by the article counting machine 12 are conveyed in a rank by endless belt 22 into position below article discharge tubes 24. Each tube 24 is supplied with articles to be filled into bottles 20 by discharge chutes 26. Articles are supplied to discharge chutes 26 by endless conveyor 28.

Conveyor 28 has a plurality of individual elongated slats 30 mounted with their long sides contiguous on the links of end chains (not shown). The end chains are mounted on sprockets (see FIG. 2) so that the conveyor moves in a direction transverse of the slats from the upper right to lower left corners in FIG. 1. A motor (not shown) drives the sprockets. Each of the slats is provided with a longitudinal row of adjacent article receiving locations in the form of product cavities 34, each adapted to receive one article to be dispensed. The rows extend the full length of the slats 30 except for short blank end portions. As shown in FIG. 1, it is contemplated that each working slat (those to receive and transport product) is provided with such cavities, although they are only partially indicated, and that the articles which they are adapted to receive and dispense are flat tablets of circular outline, it being understood that slats with cavities adapted to other articles of various sizes and shapes, or intermittent slats without cavities, may be substituted. The articles are supplied to the cavities 34 by a vibratory hopper (not shown) at the back of article counting machine 12 as the conveyor moves upwardly. A rotary brush (not shown) downstream from the hopper removes excess articles not received in cavities 34.

At the front end of article counting machine 12, visible in FIG. 1, the slats 30 are tilted so that the articles are dispensed from the open ends of the cavities 34 by gravity. Alternatively, an ejector mechanism, known to those skilled in the art, may be provided at the discharge location to positively eject individual articles from cavities 34. Although provision of a positive ejector mechanism is preferred, it is not essential to the present invention.

After a rank of bottles is filled, it is conveyed away from the discharge area by conveyor 14.

Operating controls for the article counting machine 12 are provided in control box 36 and a machine control console (not shown) connected to article counting machine 12 by suitable wiring (not shown).

A further description of the details of article counting machine 12 is unnecessary for understanding the present invention. Such article counting machines are well known and well understood by those skilled in the art. For additional structural details of article counting machine 12, reference may be made to U.S. Pat. No. 3,139,713 entitled "Pill Counting And Filling Mechanism," issued to Leland H. Merrill and the present inventor.

Still referring to FIG. 1, the present invention includes an illuminating means 38 for illuminating the article receiving cavities 34 on slats 30. As seen in FIG. 1, illuminating means 38 is mounted adjacent conveyor 28, but below apex 40 of conveyor 28. Located above conveyor 28 just above the apex 40 is a reflective screen 42. A pair of cameras 44, 46 are mounted above conveyor 28 and are arranged to view reflective screen 42. Cameras 44 and 46 are identical, and each preferably comprises a $1\times1024$ linear CCD (charge coupled device) array imaging system. Cameras 44 and 46 generate an electronic signal in response to light falling on the CCD imaging system. Such cameras are known to those skilled in the art need not be described further. Individual light sources, such as small incandescent bulbs or LEDs (not shown), may be provided at the ends and center of screen 42 to serve as alignment and focusing marks for cameras 44 and 46.

One or more compressed air nozzles (not shown) are provided adjacent the lenses of cameras 44 and 46 to direct a stream of air across the lenses. Air is blown across the lenses at intervals to remove dust and the like. One or more nozzles can also be provided adjacent screen 42 and illuminating means 38 for the same purpose.

Illuminating means 38 preferably includes a linear fiberoptic array. Light for the fiberoptic array is provided by two light sources 48, located on either side of machine 12 and optically coupled to the fiberoptic array by fiberoptic cabling 50. Only one light source 48 is visible in FIG. 1. Each light source 48 is preferably an incandescent bulb. A preferred type of bulb is a standard projection bulb, although any type of bulb may be used. A fluorescent light source or an infrared light source may also be used instead of an incandescent bulb.

The illuminating means comprises four thin, elongated light emitting apertures (not visible in the figures), arranged linearly from left to right with respect to conveyor 28. Preferred dimensions for the apertures are 10 inches by 0.010 inches. Each light source 48 supplies two of the light emitting apertures via the fiberoptic array and cabling 50. A cylindrical focusing lens 39 is located in front of the light emitting apertures and extends the full length of the array. Lens 39 may be made of either optically correct plastic or glass rod, and produces a thin, high intensity line of light focused onto screen 42, as will be described in greater detail below. Power for light sources 48 is provided by control console 52 via wiring 54.

One or more compressed air nozzles (not shown) are provided adjacent lens 39 to direct a stream of air across lens 39 at intervals in order to keep lens 39 free of dust and the like.

Control console 52 also supplies power to and receives signals from optical cameras 44 and 46 by means of wiring 56. In addition to its function of supplying power to the various components of the invention, control console 52 houses the signal processing electronics, described hereinafter, for processing the signals from cameras 44 and 46. Suitable control switches and indicator lights may be provided on panel 58 on control console 52. A printer 60 may also be provided on control console 52 for reasons which will become apparent hereinafter.

Control console 52 also provides signals to and receives signals from lighted switches 62 on operator control bar 64. Operator control bar 64 may be integral with or mounted on discharge chutes 26. Operator control bar 64 is described further below.

Figure 2:
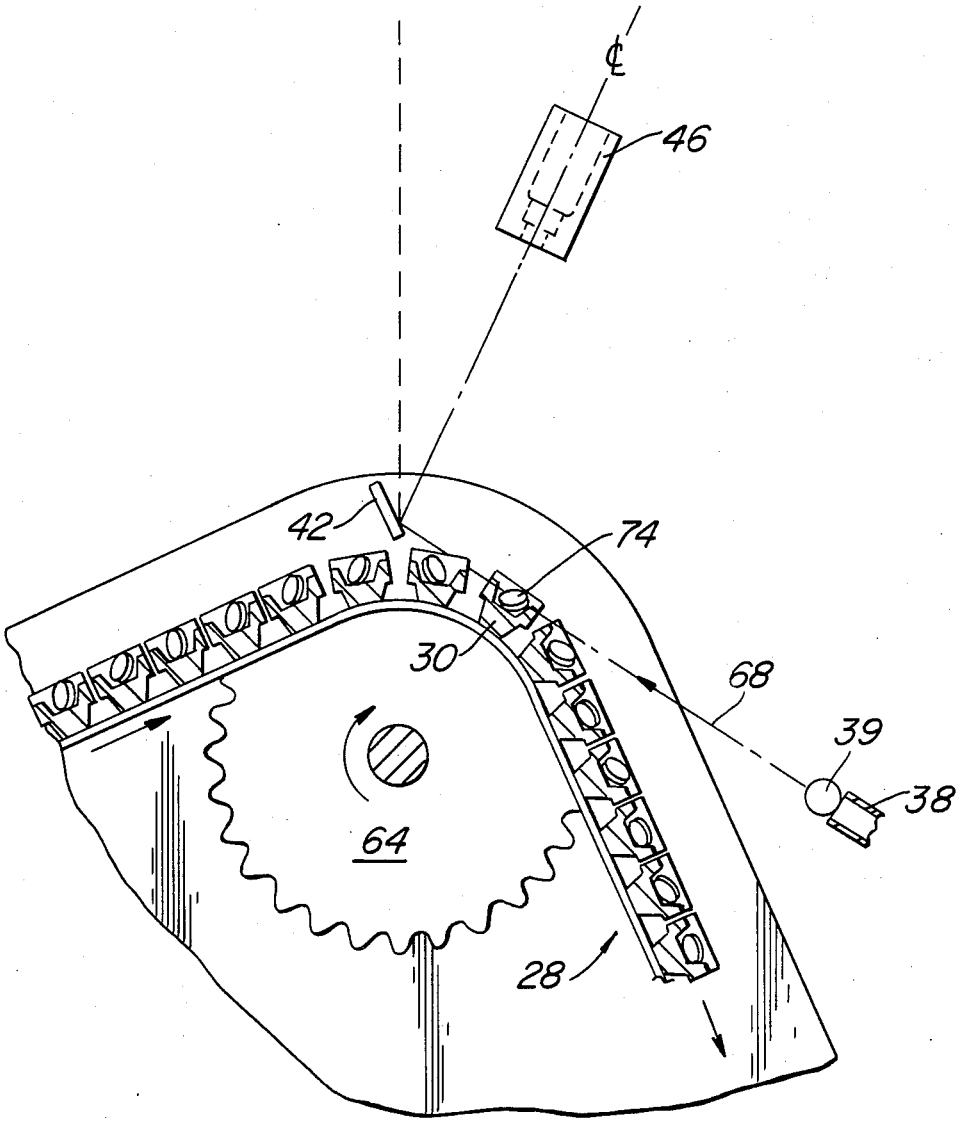
FIG. 2 is a partial section view of the apparatus illustrated in FIG. 1, illustrating the optical detecting system in operative association with the article conveyor.

Referring now to FIG. 2, there is shown a partial sectional view of the apex region of conveyor 28. Individual slats 30 are conveyed generally from left to right in FIG. 2 by the clockwise motion of sprocket 64. Illuminating means 38, in cooperation with focusing lens 39, directs an optical beam 68 at the article receiving cavities 34 on a slat 30. As shown more clearly in FIGS. 3–5, cavities 34 are formed as depressions between peak portions 70 which are located at regular intervals along slat 30. The slat illustrated in FIGS. 3–5 is configured to operate in conjunction with a positive ejector mechanism (referred to above) of the type known in the art as a blade ejector. Although a positive ejector mechanism is desirable in many article counting applications, it is not necessary to the present invention.

Referring again to FIG. 2, it can be seen that optical beam 68 is arranged to pass through cavity 34 between peak portions 70 to a reflective screen 42. If an article 74 is in cavity 34, it will interrupt optical beam 68. If there is no article in cavity 34, optical beam 68 will pass through cavity 34 and strike reflective screen 42. Reflective screen 42 will thus display a shadow when an article 74 is in cavity 34, and will display an illuminated area when cavity 34 is empty.

It will be appreciated that, since illuminating means 38 is arranged in a linear fashion with respect to the slats 30, reflective screen 42 will display a linear pattern of shadows and bright spots corresponding to the presence or absence of individual articles 74 in cavities 34 in slats 30. This pattern is detected by the linear CCD array in each of cameras 44 and 46. (Only camera 46 is shown in FIG. 2.) Cameras 44 and 46 may be arranged to have overlapping fields of view, whereby cameras 44 and 46 view overlapping portions of the pattern displayed on reflective screen 42. (On small machines, only a single camera may suffice to view the entire length of reflective screen 42. The number of cameras is not crucial to the invention.)

It is contemplated that the signal processing electronics in control console 52 be controlled by a microprocessor. The precise details of the processing circuitry and the precise manner in which the various signals described herein may be generated is not critical to the present invention. Likewise, the manner in which the microprocessor may be programmed to control operation of the processing circuitry is not critical to the present invention. Those skilled in the art will be readily familiar with the various ways in which the signals described may be generated and processed, and the way in which a micrcoprocessor may be programmed to carry out the described functions. Accordingly, the signal processing circuitry and microprocessor program are not described in detail.

As seen from FIG. 2, when a tablet 74 is missing from a slat cavity 34, the light beam 68 projected towards the slat 30 illuminates a particular area of screen 42 which is located behind the slat. This illuminated area on screen 42 is scanned by cameras 44 and 46 and the light collected by the cameras is focused on the CCD imaging system. The individual CCD photoelements are arranged in a linear array whose length is proportional to the length of screen 42. As light strikes a CCD photoelement, an electrical charge proportional to the amount of light falling on the individual photoelement is generated. At predetermined intervals, the charge level of each photoelement is read and sent over connecting cable 56 to the signal processing electronics. The electronic signal from the camera is first digitized. That is, the charge level from each photoelement is assigned a number value ranging from 0 to 1023. This value is then stored in a memory as "pixel" (picture element) data for processing by the microprocessor. In response to the electronic signal from cameras 44 and 46, the processing circuitry generates a second electronic signal which is indicative of the presence or absence of an article in one or more individual cavities 34. The digitized signal from the cameras is compared by the microprocessor to data stored in memory. The data stored in memory may represent a known condition, such as an article 74 in each cavity 34 on a slat, or the absence of articles from all cavities in a slat. The microprocessor is thus able to compare the actual digitized camera signal to a standard reference to enable it to determine when an article is present or absent from a cavity.

The processing circuitry may also include circuitry responsive to the second electronic signal for generating a count signal which is indicative of the total number of articles delivered to individual receptacles. The processing circuitry may further include circuitry which is responsive to the count signal for generating an eject signal for ejecting an individual bottle when the count signal indicates that the total number of articles delivered to the receptacle is outside predetermined limits, for example below a predetermined minimum number of articles. As the bottles are conveyed past the bottle counting sensor (not shown, but part of conveyor 14), the microprocessor will "count" bottles until an under-filled bottle is opposite a reject station. A reject mechanism 35, such as a star wheel, air jet or known reject mechanism, is then actuated to reject the under-filled bottle.

When a new rank of bottles 20 is ready to be indexed to position for filling, the signal processing circuitry is reset, and the inspection and signal processing procedure is ready to be repeated.

The microprocessor may be programmed for both automatic and manual operation of the optical detection system. In the automatic mode, as already described, the system will detect the absence of articles, and may in addition generate an audible and/or visible alarm to alert the operator. The corresponding under-filled bottle(s) will be automatically ejected at the reject station.

In the manual mode, the microprocessor can be programmed to stop the machine 12 when the absence of an article is detected. At the same time, the microprocessor will cause the corresponding lighted switch 62 to flash, indicating an under-filled bottle. An audible alarm may also be sounded. At this point, the operator has the option of either correcting the fault manually (i.e., by manually placing an article into the under-filled receptacle) or pressing flashing switch 62, which will generate a signal to the microprocessor that the under-filled receptacle is to be ejected at the reject station. After one of the options is exercised, the machine may be restarted by the operator by means of controls 36.

A shaft encoder, not shown, may be provided on sprocket 64 to generate a signal each time a new slat 30 is in the proper position to be illuminated by fiberoptic emitters 66. Alternatively, any other means of generating a timing signal, such as a microswitch actuated by passage of the slats or an electro optic detector, may be used. The timing signal may be used to pulse light source 48 so that light source 48 is on, and hence optical beam 68 is produced, only when a slat 30 is in the proper position to be illuminated. Likewise, cameras 44 and 46 can be turned off except when a slat 30 is in proper position for illumination. The timing signal can be used in the processing circuitry to develop the count signal. In addition, by turning cameras 44 and 46 on only when a slat is in proper position for illumination, extraneous signals can be avoided.

The microprocessor may be programmed to maintain a count of the total number of under-filled ("short") receptacles, the total number of properly-filled ("good") receptacles, and a grand total of short plus good receptacles. This information may be made available in documentary form by means of printer 60, which produces a printed record of the information for monitoring and other purposes.

The microprocessor can also be readily programmed by those skilled in the art for "self-testing." That is, the microprocessor can be programmed to automatically check camera alignment, focus, lighting, and dirty screen after each rank of receptacles is filled. Results of the self-test may be displayed on control panel 58.

The present invention may be embodied in other specific forms without departing from the spirit or essential attributes thereof and, accordingly, reference should be made to the appended claims, rather than to the foregoing specification, as indicating the scope of the invention.

I claim:

1. In a machine for counting individual articles and delivering a preselected quantity of said articles into a plurality of receptacles arranged in a rank, the machine having an endless conveyor having elongated article receiving flights adapted to receive, transport and discharge the articles into the receptacles, each article receiving flight having a plurality of spaced article receiving locations therealong, each for receiving a single article and corresponding to one of said receptacles, apparatus for detecting the presence and absence of individual articles in said article receiving flights prior to discharge, comprising:

(a) illuminating means for illuminating said article receiving locations with an optical beam for producing optically-detectable indications of the presence or absence of an article in one or more individual article receiving locations, (b) reflective means for displaying said optically-detectable indications, (c) optical detector means operatively associated with said reflective means for detecting said indications and for generating an electronic signal representative of said indications, and (d) processor means for processing said electronic signal and generating in response thereto a second electronic signal indicative of the presence or absence of an article in one or more individual article receiving locations.

2. Apparatus according to claim 1, wherein said illuminating means comprises an elongated aperture arranged adjacent the article receiving flights of said conveyor, the length of the aperture being at least as great as the length of said article receiving flights.

3. Apparatus according to claim 1 wherein said article receiving locations include an opening therethrough and said optical beam is arranged to pass through said opening in the absence of an article in said opening and produce an optically-detectable indication in the form of an illuminated area on said reflective means.

4. Apparatus according to claim 1, wherein said optical beam is in the infrared portion of the spectrum.

5. Apparatus according to claim 1, wherein said optical beam is in the visible portion of the spectrum.

6. Apparatus according to claim 1 wherein said reflective means comprises an elongated reflective screen.

7. Apparatus according to claim 1, wherein said optical detector means comprises at least one camera arranged to view the optically-detectable indications displayed on said reflective means.

8. Apparatus according to claim 7, wherein said at least one camera comprises a solid-state imaging system.

9. Apparatus according to claim 7, wherein said optical detector means comprises two cameras, each camera arranged to view at least a portion of the optically-detectable indications displayed on said reflective means.

10. Apparatus according to claim 1, further comprising means responsive to said second electronic signal for generating one or more count signals indicative of the total number of articles delivered to individual receptacles.

11. Apparatus according to claim 10, further comprising means responsive to said count signals for ejecting an individual receptacle when the total number of articles delivered to said receptacle is below a predetermined minimum.

12. Apparatus according to claim 1 further comprising means responsive to said second electronic signal for generating an operator-detectable indication of the presence or absence of an article in one or more individual article receiving locations.

13. Apparatus according to claim 12, further comprising operator-actuatable means for ejecting a receptacle corresponding to an empty article receiving location when said operator-detectable indication indicates the absence of an article in said article receiving location.

14. In a machine for counting individual articles and delivering a preselected quantity of said articles into a plurality of receptacles arranged in a rank, the machine having an endless conveyor having elongated article receiving flights adapted to receive, transport and discharge the articles into the receptacles, each article receiving flight having a plurality of spaced article receiving locations therealong, each for receiving a single article and corresponding to one of said receptacles, apparatus for detecting the presence and absence of individual articles in said article receiving flights prior to discharge, comprising:

(a) illuminating means for illuminating said article receiving locations with an optical beam for producing optically-detectable indications of the presence or absence of an article in one or more individual article receiving locations, said illuminating means having an elongated aperture arranged adjacent the article receiving flights of said conveyor, the length of the aperture being at least as great as the length of said article receiving flights, (b) a reflective screen for displaying said optically-detectable indications, (c) at least one camera arranged to view the optically-detectable indications displayed on said reflective screen and for generating an electronic signal representative of said indications, (d) processor means for processing said electronic signal and generating in response thereto a second electronic signal indicative of the presence or absence of an article in one or more individual article receiving location, (e) means responsive to said second electronic signal for generating one or more count signals indicative of the total number of articles delivered to individual receptacles, (f) means responsive to said count signals for ejecting an individual receptacle when the total number of articles delivered to said receptacle is below a predetermined minimum;

(g) means responsive to said second electronic signal for generating an operator-detectable indication of the presence or absence of an article in one or more individual article receiving locations; and (h) operator-actuatable means for ejecting a receptacle corresponding to an empty article receiving location when said operator-detectable indication indicates the absence of an article in said article receiving location.

15. Apparatus according to claim 14 wherein said article receiving locations include an opening therethrough and said optical beam is arranged to pass through said opening in the absence of an article in said opening and produce an optically-detectable indication in the form of an illuminated area on said reflective screen.

16. Apparatus according to claim 14, wherein said optical beam is in the infrared portion of the spectrum.

17. Apparatus according to claim 14, wherein said optical beam is in the visible portion of the spectrum.

18. Apparatus according to claim 7, wherein said at least one camera comprises a solid-state imaging system.

19. Apparatus according to claim 7, wherein said optical detector means comprises two cameras, each camera arranged to view at least a portion of the optically-detectable indications displayed on said reflective means.

20. In a machine for counting individual articles and delivering a preselected quantity of said articles into a plurality of receptacles arranged in a rank at a filling location, the machine having an endless conveyor having elongated article receiving flights adapted to receive, transport and discharge the articles into the receptacles, each article receiving flight having a plurality of spaced article receiving locations therealong, each for receiving a single article and corresponding to one of said receptacles, and having a conveyor for conveying said receptacles past a discharge location, apparatus for detecting the presence and absence of individual articles in said article receiving flights prior to discharge, comprising:

(a) illuminating means for illuminating said article receiving locations with an optical beam in the visible portion of the spectrum for producing visible indications of the presence or absence of an article in one or more individual article receiving locations, said illuminating means having an elongated aperture arranged adjacent the article receiving flights of said conveyor, the length of the aperture being at least as great as the length of said article receiving flights;

(b) an elongated reflective screen for displaying said visible indications;

(c) a pair of solid state imaging cameras, each camera arranged to view at least a portion of the visible indications displayed on said elongated reflective screen and for generating an electronic signal representative of said indications;

(d) processor means for processing said electronic signal and generating in response thereto a second electronic signal indicative of the presence or absence of an article in one or more individual article receiving locations;

(e) means responsive to said second electronic signal for generating one or more count signals indicative of the total number of articles delivered to individual receptacles;

(f) means for tracking individual receptacles from said filling location to said discharge location and for generating a position signal indicative of the position of said individual receptacles;

(g) means responsive to said count and position signals for ejecting an individual receptacle at said discharge location when the total number of articles delivered to said receptacle is below a predetermined minimum;

(h) means responsive to said second electronic signal for generating an operator-detectable indication of the presence or absence of an article in one or more individual article receiving locations; and (i) operator-actuatable means for ejecting at said discharge location a receptacle corresponding to an empty article receiving location when said operator-detectable indication indicates the absence of an article in said article receiving location.

21. Apparatus according to claim 20 wherein said article receiving locations include an opening therethrough and said optical beam is arranged to pass through said opening in the absence of an article in said opening and produce an optically-detectable indication in the form of an illuminated area on said reflective screen.

* * * * *